US009267656B2

(12) United States Patent
Guan

(10) Patent No.: US 9,267,656 B2
(45) Date of Patent: Feb. 23, 2016

(54) HEAD LAMP FOR VEHICLE

(71) Applicant: SL Corporation, Daegu (KR)

(72) Inventor: Jeong Myong Guan, Gyeongsangbuk-Do (KR)

(73) Assignee: SL Corporation, Daegu (KR)

( * ) Notice: Subject to any disclaimer, the term of this patent is extended or adjusted under 35 U.S.C. 154(b) by 27 days.

(21) Appl. No.: 14/015,306

(22) Filed: Aug. 30, 2013

(65) Prior Publication Data

US 2014/0085917 A1 Mar. 27, 2014

(30) Foreign Application Priority Data

Sep. 24, 2012 (KR) ..... 10-2012-0105941

(51) Int. Cl.
*F21V 7/00* (2006.01)
*F21S 8/10* (2006.01)

(52) U.S. Cl.
CPC ..... *F21S 48/1789* (2013.01); *F21S 48/14* (2013.01); *F21S 48/145* (2013.01); *F21S 48/1778* (2013.01)

(58) Field of Classification Search
USPC ..... 362/512–515, 539
See application file for complete search history.

(56) References Cited

U.S. PATENT DOCUMENTS

2009/0109697 A1* 4/2009 Kim et al. ..... 362/512

FOREIGN PATENT DOCUMENTS

| | | | |
|---|---|---|---|
| CN | 101871612 | A | 10/2010 |
| CN | 102252280 | A | 11/2011 |
| JP | 07329660 | | 12/1995 |
| JP | 2005259473 | A | 9/2005 |
| JP | 2010026759 | | 2/2010 |
| JP | 2012-011937 | A | 1/2012 |
| KR | 1020080008527 | | 1/2008 |
| KR | 10-2012-0011213 | A | 2/2012 |

* cited by examiner

*Primary Examiner* — Sean Gramling
(74) *Attorney, Agent, or Firm* — Mintz Levin Cohn Ferris Glovsky and Popeo, P.C.; Kongsik Kim; Colleen H. Witherell

(57) ABSTRACT

A head lamp for a vehicle is provided. In particular, the head lamp includes a first light source, a first reflector configured to reflect light generated from the first light source, a first optical shield disposed at a front side of the first light source and configured to block a portion of the light, a second optical shield disposed at the front side of the first light source and configured to block another portion of the light so as to form a first shaded line on a front light distribution pattern of the vehicle; and a first lens configured to emit the incident light toward the front side.

17 Claims, 18 Drawing Sheets

RELATED ART

RELATED ART

RELATED ART

HEAD LAMP FOR VEHICLE

CROSS-REFERENCE TO RELATED APPLICATION

This application claims priority from Korean Patent Application No. 10-2012-0105941 filed on Sep. 24, 2012 in the Korean Intellectual Property Office, and all the benefits accruing therefrom under 35 U.S.C. 119, the contents of which in its entirety are herein incorporated by reference.

BACKGROUND

The present invention relates to a head lamp for a vehicle, and more particularly, to a head lamp for a vehicle, capable of displaying a vehicle width line of a vehicle.

In general, a vehicle is provided with various lamps for illuminating various areas around and within the vehicle. These lamps allow a driver to easily identify objects within the periphery of the vehicle when the vehicle is driven at night, and provide a signal function that informs other drivers or persons around the vehicle of a driving state of the vehicle. For example, a head lamp, a fog lamp, and the like are mainly provided for the purpose of providing light, and a turn signal lamp, a tail lamp, a brake lamp, a side marker, and the like are provided for the purpose of signaling.

In general, as the lamp for a vehicle, a light source such as a halogen lamp or a high intensity discharge (HID) is commonly used. Recently, however, as the light source, light emitting diodes have started to be used which have a color temperature of about 5,500 K, which is close to a color temperature of sun light, so as to reduce eye strain that causes fatigue. In addition, light emitting diodes minimize the size of the lamp that is required thus increasing the degree of design freedom of the lamp, and also increasing the economic efficiency because light emitting diodes typically have a semi-permanent lifespan.

In particular, light emitting diodes are help to reduce the complexity of the head lamp, increase the lifespan of the light source and are much smaller in size, thus being able to be used in must smaller spaces. Thus, when a light emitting diode is used, one or more light emitting diodes may be used in order to irradiate light in each beam pattern and secure a sufficient quantity of light.

Meanwhile, when the vehicle is driven at night, there may be a case in which the vehicle passes through a narrow alley, passes through a narrow width between the vehicles, or is parked in a narrow parking lot. When the driver is inexperienced in driving the vehicle, or the driver does not have a proper understanding of the width of the vehicle that is being driven by the driver, there is a high possibility that a minor collision will occur when the driver drives the vehicle in narrow environments.

For example, as illustrated in FIG. 1, in a case where a bicycle, a motorcycle 20, or the like is driven at the periphery of a road, when the driver intends to pass the corresponding bicycle or the motorcycle 20 but miscalculates the vehicle width of a host vehicle 10, the vehicle may unintentionally come into contact with or collide with the bicycle and the motorcycle 20, and as a result, there is a likelihood that an accident causing injury to the bicyclist or motorcyclist will occur.

In addition, as illustrated in FIG. 2, when a plurality of vehicles are parked in a narrow space, when the driver miscalculates the vehicle width of the host vehicle or the driver erroneously and unreasonably drives the vehicle to pass through a narrow space in a process in which the host vehicle 10 passes close to an oncoming vehicle 30, there is a possibility that a minor collision will occur between the host vehicle 10 and the oncoming vehicle 30 or other stopped vehicles 40.

In general, minor collisions make up a major part of the vehicle accidents, and a major reason for the minor collision is that the driver erroneously calculates the vehicle width of the host vehicle. Therefore, a countermeasure, which allows the driver to easily identify and comprehend the vehicle width of the vehicle that is being driven by the driver, is required.

Furthermore, as illustrated in FIG. 3, the host vehicle 10 may be unintentionally change lanes from a traffic lane in a driving path L1 on which the host vehicle 10 is driven, and this may lead to a serious accident. Particularly, when the vehicle is being driven at night, due to various reasons such as driving while drowsy, the driver may not maintain the driving path on which the vehicle is driven. Therefore, it is necessary for the driver to immediately be notified when the vehicle is biased to one side of the driving path or the vehicle crosses over the traffic lane.

SUMMARY

The present invention has been made in an effort to provide a head lamp for a vehicle which allows a driver to be able to safely drive or park a host vehicle in a narrow space.

The objects of the present invention are not limited to the aforementioned object, and other objects, which are not mentioned above, will be apparently understood by the person skilled in the art from the following description.

An exemplary embodiment of the present invention provides a head lamp for a vehicle including: a first light source; a first reflector configured to reflect light generated from the first light source; a first optical shield disposed at a front side of the first light source and configured to block a portion of the light; a second optical shield disposed at the front side of the first light source and configured to block another portion of the light so as to form a first shaded line on a front light distribution pattern of the vehicle; and a first lens configured to emit an incident light toward the front side.

Specific items of other exemplary embodiments are included in the detailed description and the drawings.

According to the head lamp for a vehicle of the present invention, as described above, there are one or more effects as follows.

That is, according to the head lamp for a vehicle according to the exemplary embodiments of the present invention, the pair of shaded lines, which correspond to the vehicle width, is formed on the light distribution pattern irradiated toward the front side of the vehicle so that the vehicle driver may safely drive or park the host vehicle in a narrow space based on the pair of shaded lines.

In addition, the pair of shaded lines which the driver may use to intuitively recognize the vehicle width of the host vehicle is formed, thereby preventing an unintentional minor collision with other vehicles, bicycles, or motorcycles, or an injury accident.

The effects of the present invention are not limited to the aforementioned effects, and other effects, which are not mentioned above, will be apparently understood by the person skilled in the art from the recitations of the claims.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE EMBODIMENTS

Figure 1:
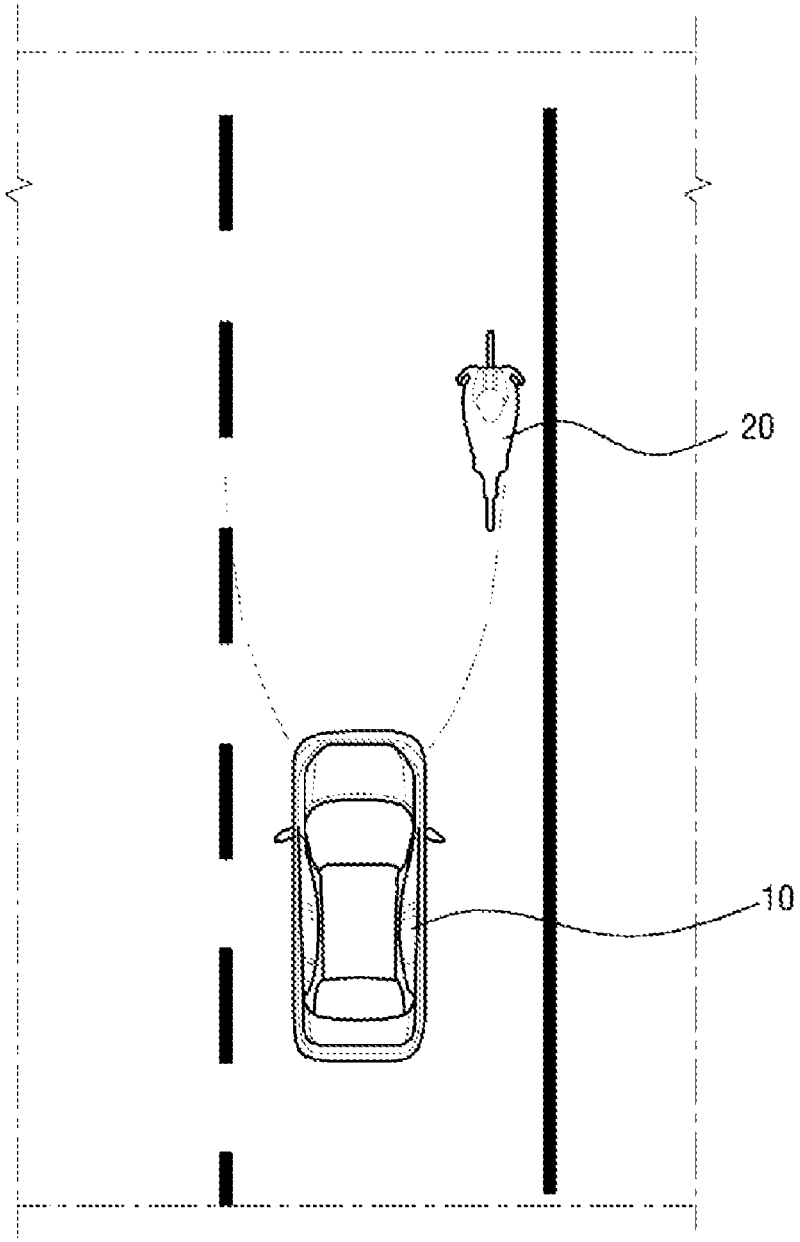
FIGS. 1 to 3 are views illustrating a light distribution pattern according to a head lamp structure of the related art.
Figure 2:
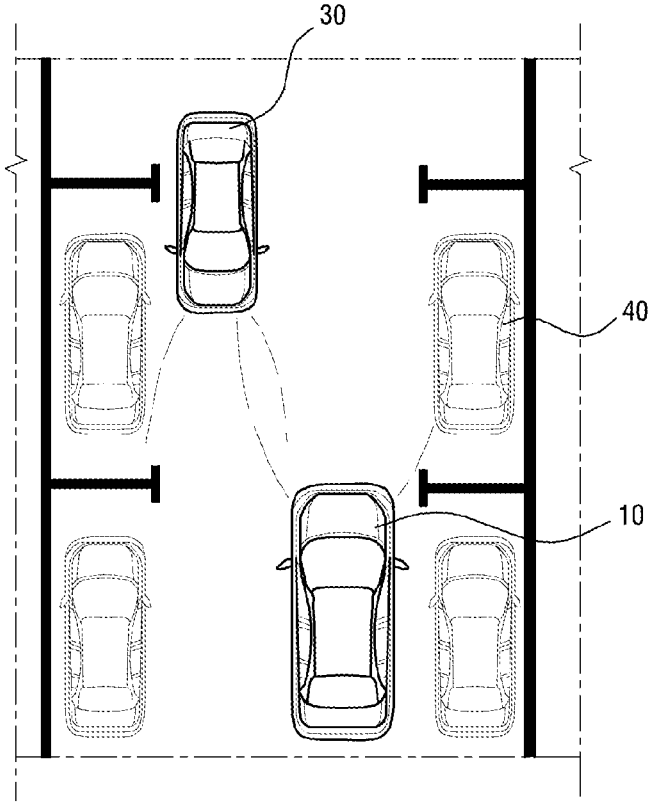
Figure 3:
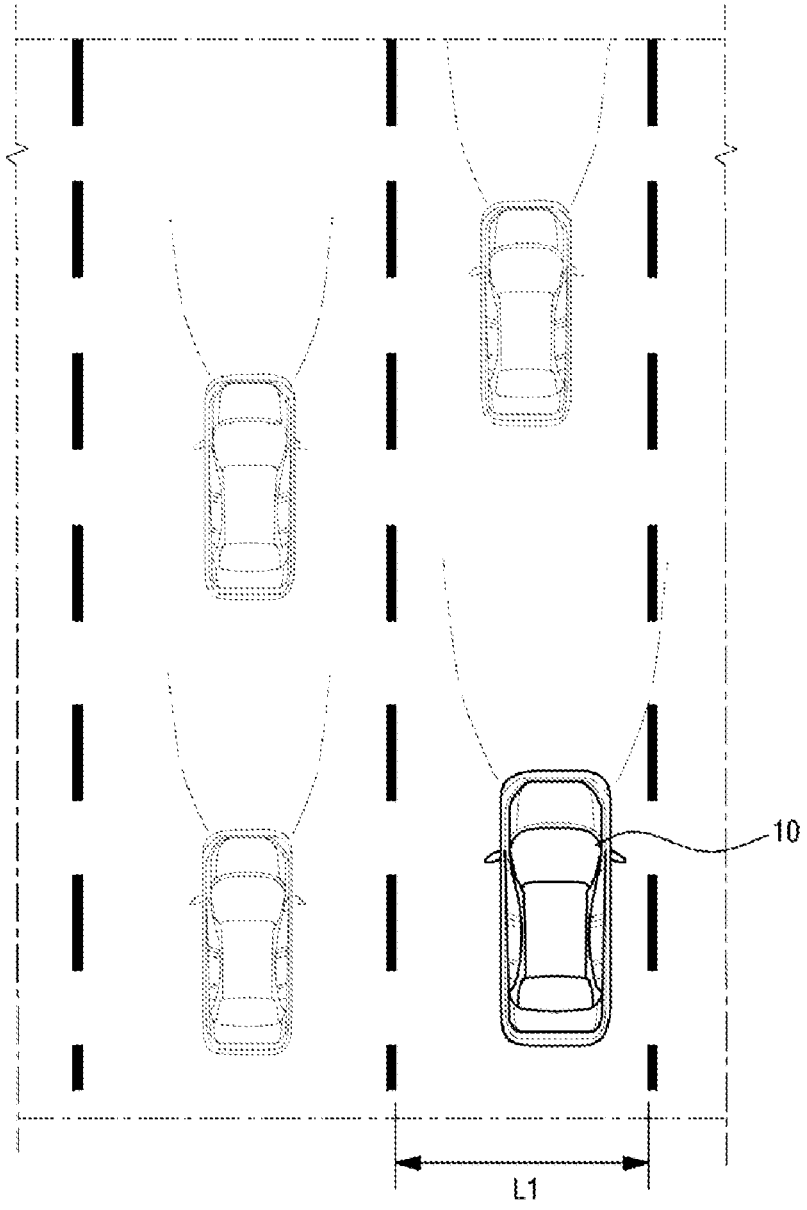

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Figure 4:
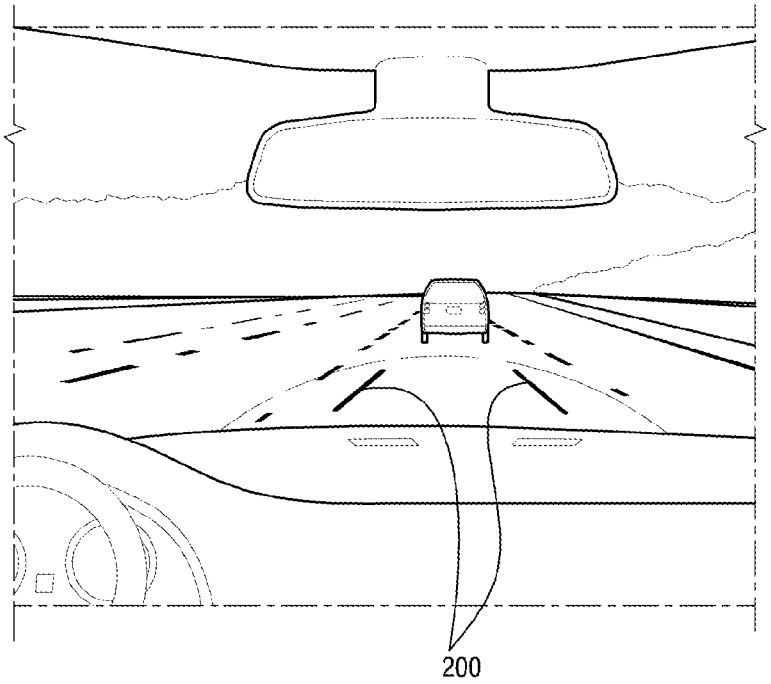
FIG. 4 is a view illustrating an example of shaded lines formed by a head lamp for a vehicle according to exemplary embodiments of the present invention.
Figure 5:
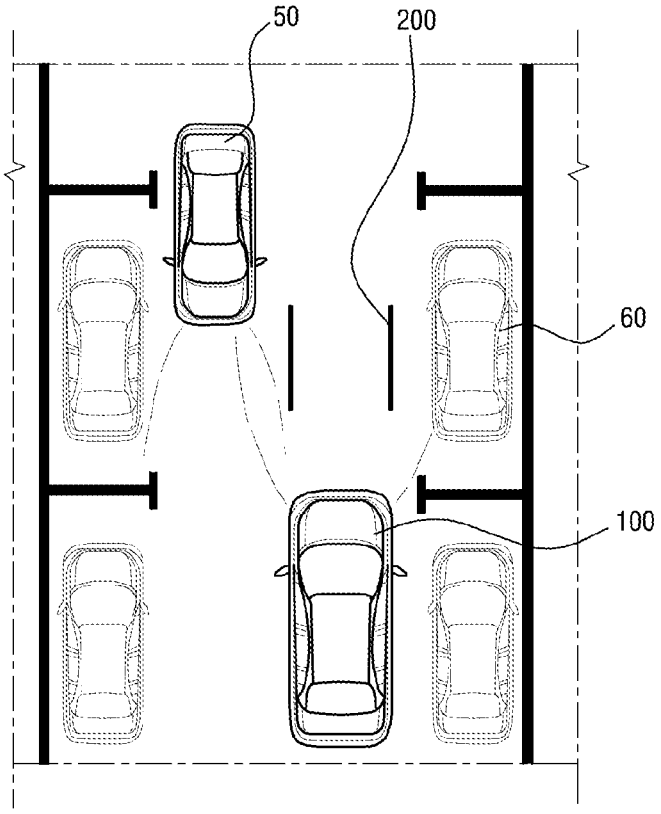
FIGS. 5 to 7 are views illustrating an example of shaded lines formed by the head lamp for a vehicle of FIG. 4 in various situations.
Figure 6:
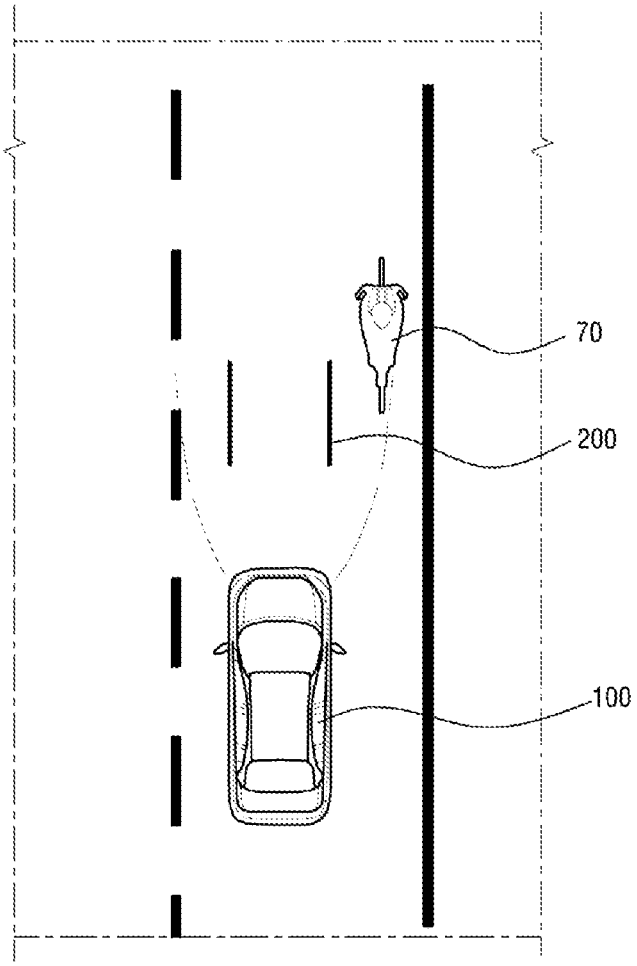
Figure 7:
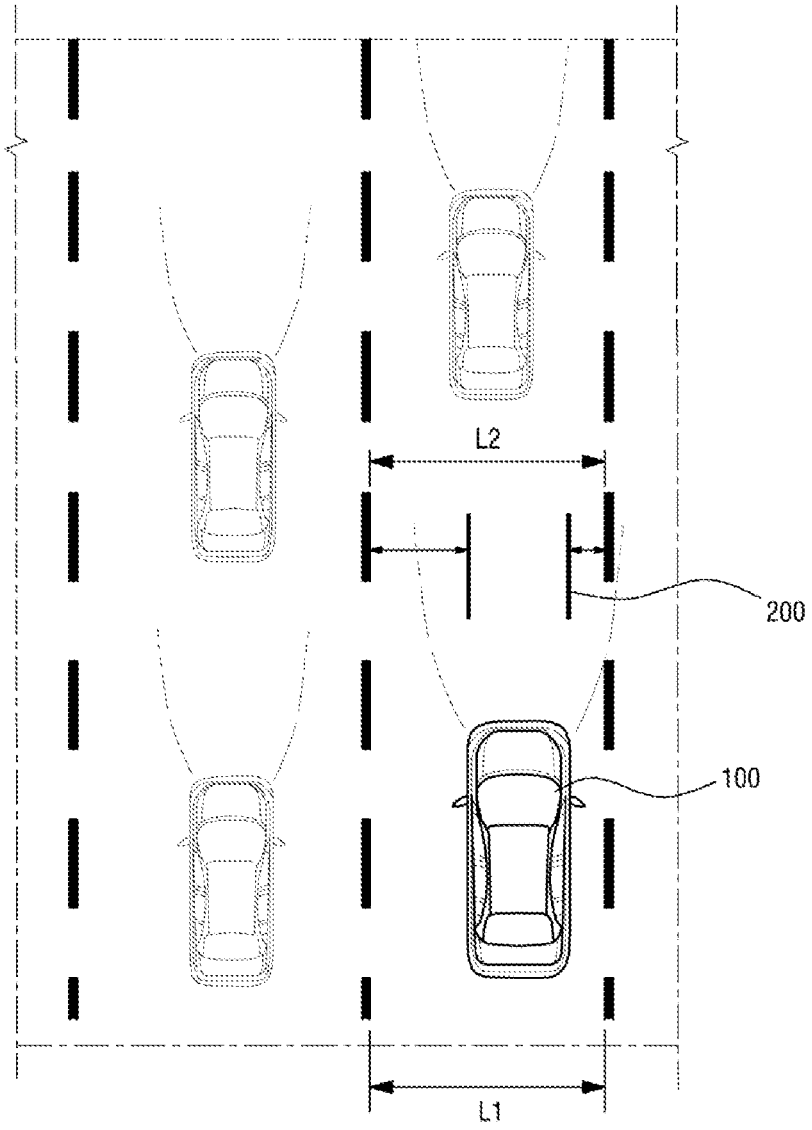

Hereinafter, a head lamp for a vehicle according to exemplary embodiments of the present invention will be described with reference to FIGS. 4 to 7. FIG. 4 is a view illustrating an example of shaded lines formed by a head lamp for a vehicle according to exemplary embodiments of the present invention, and FIGS. 5 to 7 are views illustrating an example of shaded lines formed by the head lamp for a vehicle of FIG. 4 in various situations.

Additionally, it is understood that the below methods are executed by at least one controller. The term controller refers to a hardware device that includes a memory and a processor configured to execute one or more steps that should be interpreted as its algorithmic structure. The memory is configured to store algorithmic steps and the processor is specifically configured to execute said algorithmic steps to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Referring to FIG. 4, a control system of the head lamp for a vehicle according to the exemplary embodiments of the present invention may irradiate light toward a front side of a vehicle, and may block a portion of the light so as to form a pair of shaded lines 200. The pair of shaded lines 200 may be formed along the front side of the vehicle, the pair of shaded lines 200 refers to a shaded region, which is formed by blocking a portion of a low beam irradiated from the head lamp, and may be in the form of a bar or a slit that is elongated in a proceeding direction of the vehicle. The pair of shaded lines 200 may have the same length and the same thickness as each other, and the length and the thickness thereof may vary within a distinguishable range of a vehicle driver.

As illustrated in FIG. 4, when the vehicle driver drives the host vehicle, the pair of shaded lines 200 may be formed toward the front side of the vehicle so as to serve as a guide when the vehicle is driven or when the vehicle is parked. To this end, an interval between the pair of shaded lines 200 may be set to be substantively the same as a vehicle width of the host vehicle that is being driven.

That is, due to perspective or depth perception difficulties, it may be difficult for the vehicle driver to determine whether the host vehicle may pass through a narrow region in front of the vehicle, or whether the host vehicle is being driven within a center portion of a driving path (e.g., lane). As such, a minor collision or the like is likely to occur when the vehicle driver is not able to appreciate the actual width of the vehicle at night when it is difficult for most drivers to see.

In order to prevent the aforementioned difficulty, the head lamp for a vehicle according to the exemplary embodiments of the present invention may be configured to form the shaded lines having the same width as the vehicle width by blocking a portion of the light from the head lamp, which may be irradiated toward the front side of the vehicle.

Referring to FIG. 5, when a plurality of vehicles are parked in a narrow space, the pair of shaded lines 200 may be formed so as to allow the vehicle driver to easily identify the width of the host vehicle while the host vehicle 100 is passing close to an oncoming vehicle 50, or prevent the vehicle driver from erroneously and unreasonably driving the vehicle into a space that is more narrow than the vehicle, thereby preventing a minor collision with the oncoming vehicle 50 or other stopped vehicles 60.

That is, through the use of the pair of shaded lines 200 having the same width as the vehicle width of the host vehicle 100, the driver of the host vehicle 100 may objectively determine in advance whether the host vehicle may pass through the narrow space, while comparing the width of the narrow space with the vehicle width of the host vehicle 100, before the host vehicle 100 enters the narrow space.

Referring to FIG. 6, when a bicycle, a motorcycle 70, or the like travels at a periphery of the road, the driver may identify in advance the vehicle width of the host vehicle 100 through the pair of shaded lines 200 when the head lamp are emitting light, and when the driver intends to pass the corresponding bicycle or the motorcycle 70, the shaded line can prevent the driver of the host vehicle from coming into contact with the bicycle or motorcycle 70.

Furthermore, a driver of the bicycle or the motorcycle 70 may easily identify the shaded lines 200 of the approaching vehicle by seeing the lines in front of the vehicle, and when the bicycle or the motorcycle 70 is close to the shaded lines 200, the driver of the bicycle or the motorcycle 70 may move the bicycle or the motorcycle 70 away from the shaded lines 200 by to also aide in preventing an accident.

Referring to FIG. 7, the host vehicle 100 may be unintentionally moved away from a traffic lane of a driving path L2 in which the host vehicle 100 is driven, and particularly, due to various reasons such as driving while drowsy when the host vehicle 100 is driven at night, the host vehicle 100 may not be kept in the driving path L2 in which the host vehicle 100 is driven. In this case, the pair of shaded lines 200 may be generated on the road when the head lamp irradiates light such that the driver may immediately identify whether the host vehicle 100 is present in the driving path L2, and the driver may immediately recognize whether the host vehicle 100 is biased to one side of the driving path L2 of the host vehicle 100, or whether the host vehicle 100 is being driven in as state in which the host vehicle 100 crosses over the traffic lane.

Figure 8:
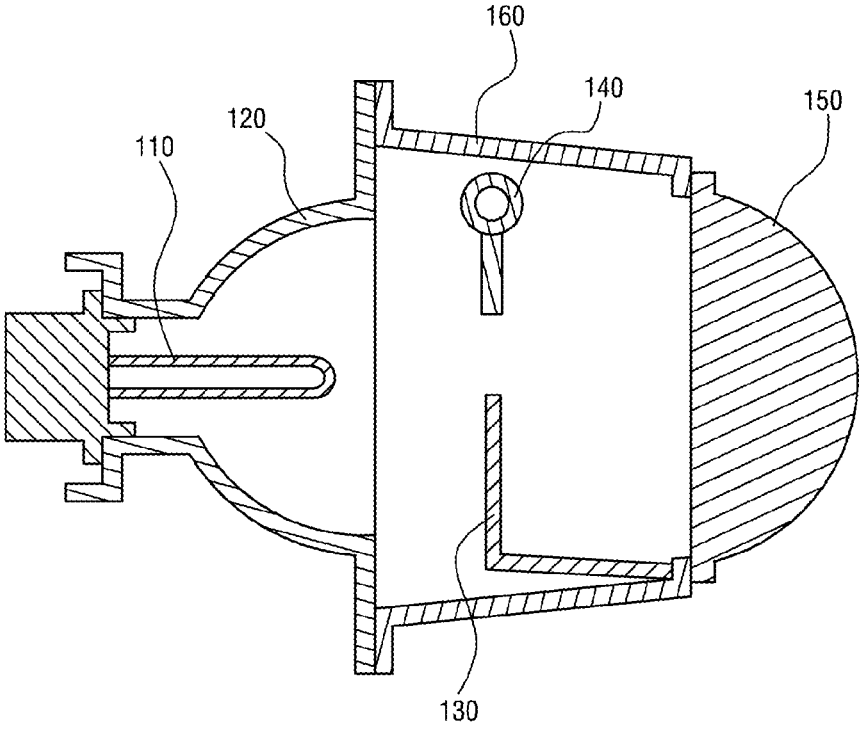
FIG. 8 is a view illustrating a schematic structure of the head lamp for a vehicle according to the exemplary embodiment of the present invention.
Figure 10:
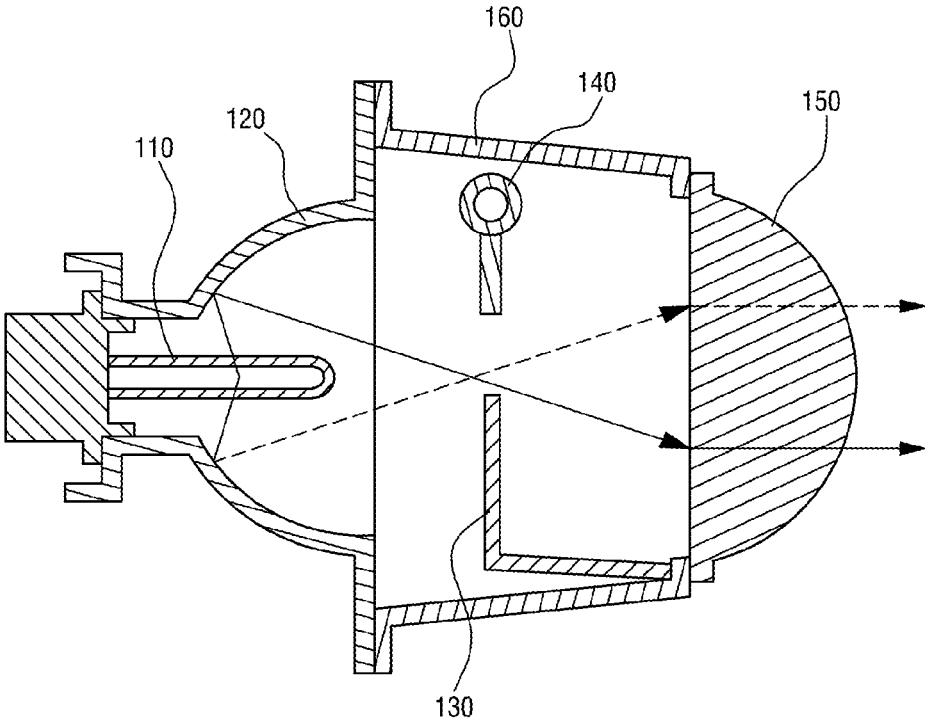
FIG. 10 is a view illustrating an optical path of the head lamp for a vehicle of FIG. 8.
Figure 11:
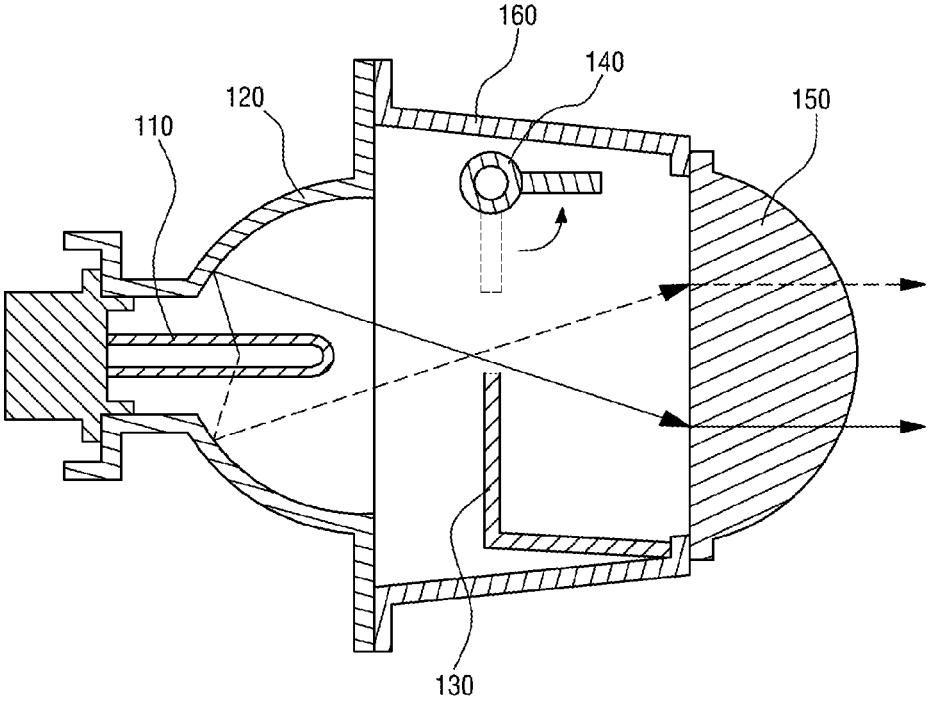
FIG. 11 is a view illustrating a displacement structure of a second optical shield which configures the head lamp for a vehicle of FIG. 8.
Figure 12:
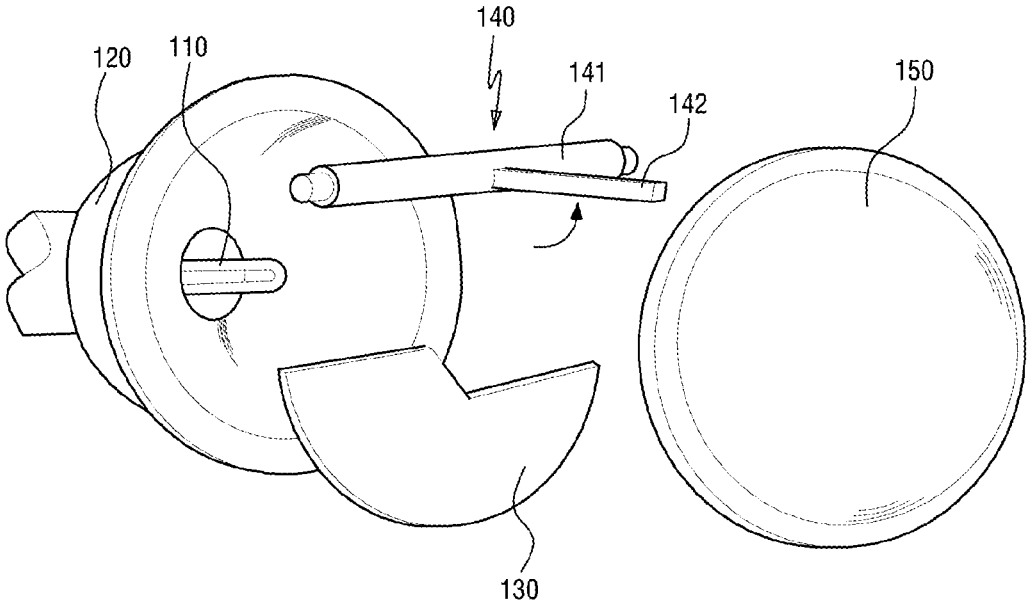
FIG. 12 is a perspective view illustrating the structure of the head lamp for a vehicle of FIG. 11.

Hereinafter, a structure of the head lamp for a vehicle according to the embodiment of the present invention will be described with reference to FIGS. 8 to 12. FIG. 8 is a view illustrating a schematic structure of the head lamp for a vehicle according to the exemplary embodiment of the present invention, FIG. 9 is a perspective view illustrating the structure of the head lamp for a vehicle of FIG. 8, FIG. 10 is a view illustrating an optical path of the head lamp for a vehicle of FIG. 8, FIG. 11 is a view illustrating a displacement structure of a second optical shield which configures the head lamp for a vehicle of FIG. 8, and FIG. 12 is a perspective view illustrating the structure of the head lamp for a vehicle of FIG. 11.

The head lamp for a vehicle according to the exemplary embodiment includes a first light source 110, a first reflector 120 configured to reflect light generated from the first light source 110, a first optical shield 130 disposed at a front side of the first light source 110 and configured to block a portion of light, a second optical shield 140 disposed at the front side of the first light source 110 and configured to block another portion of the light so as to form a first shaded line 200 on a front light distribution pattern of the vehicle, and a first lens 150 configured to emit incident light toward the front side.

Figure 9:
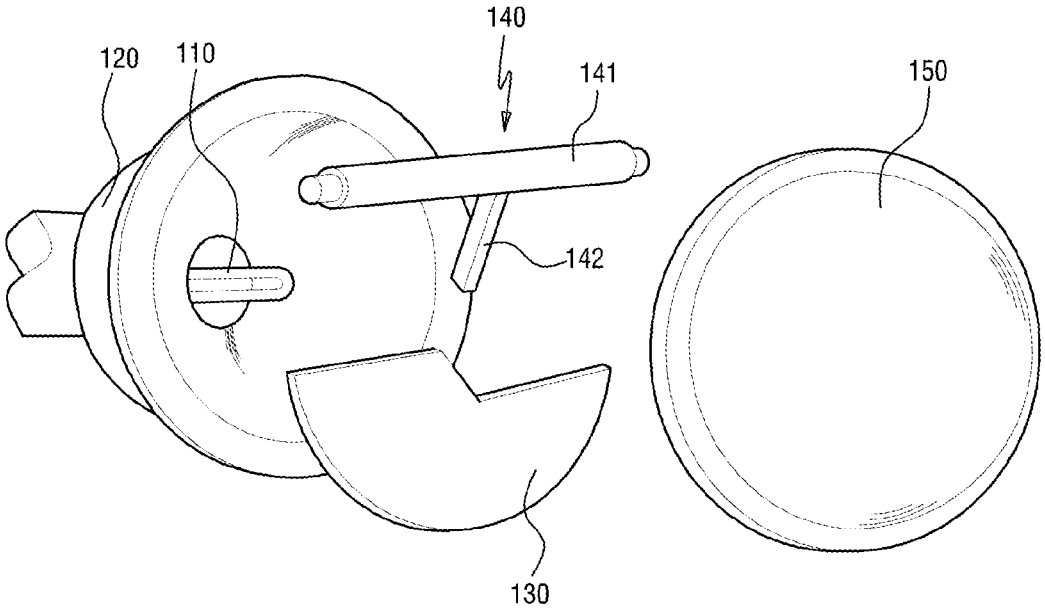
FIG. 9 is a perspective view illustrating the structure of the head lamp for a vehicle of FIG. 8.

Referring to FIGS. 8 and 9, the first light source 110 may be a projection type of light source that may be a light emitting module that generates light. The projection type of head lamp has characteristics of collecting light to one place, and therefore the projection type of head lamp has a merit in terms of light distribution in comparison with a general clear type, and may provide a sporty and esthetic look to a shape of the front surface of the vehicle. For example, the first light source 110 may include a discharge bulb, and a light emitting unit which emits light due to the discharge bulb, and for example, the discharge bulb may be a metal-halide bulb.

The first light source 110 generates a predetermined light and provides the generated light to the outside. Although it is illustrated that the first light source 110 has a single light source structure, the exemplary embodiment is not limited thereto, and a plurality of light sources may be formed as a single unit so as to generate light.

The first reflector 120 serves to guide light toward a desired position by reflecting light emitted from the first light source 110. The first reflector 120 may be formed to be adjacent to the first light source 110, and configured in the form of a hemisphere as illustrated, so as to secure a reflection path of the generated light, but the present invention is not limited thereto.

As illustrated in FIG. 10, among the light emitted from the first light source 110, the light emitted in an upper direction may be reflected on an inner reflection surface of the first reflector 120 and then proceeds in a lower direction, and the light emitted in the lower direction may be reflected on an inner reflection surface of the first reflector 120 and then proceeds in the upper direction. Except for the case in which the vehicle irradiates a high beam, the light may be emitted in the lower direction and the light proceeding in the upper direction may be blocked by the first optical shield 130 so as not to inconvenience other drivers.

On a cross-sectional surface, one end of the first reflector 120 may be adjacent to the first light source 110, and the other end of the first reflector 120 may be extended to a position that may be in contact with a first cover 160.

In several other exemplary embodiments, a scattered reflection layer or a diffuse layer may be formed on a surface of the first reflector 120. That is, when the light is emitted from the first light source 110, the light may be emitted through the first lens 150 at the front side in a state in which the light is uniformly spread by being irregularly and diffusely reflected by the first reflector 120. In this case, the light emitted through the first lens 150 may have brightness that shows overall uniform distribution like a type of light emitted from a surface light source. The scattered reflection layer formed on the surface of the first reflector 120 may include fine unevenness in a repetitive form, and the light may be irregularly reflected by the fine unevenness so as to have overall uniform brightness.

As described above, the first optical shield 130 forms a boundary line or a boundary surface of the light distribution pattern projected toward the front side of the vehicle. A portion of light may be blocked by the first optical shield 130, and the remaining light passes over the first optical shield 130, may be refracted by the first lens 150, and may proceed towards the front side of the vehicle.

Here, by blocking light, which enters with a predetermined height or more of the first lens 150, using the first optical shield 130, a low beam pattern may be formed at a lower portion of a cutoff line. A basic light distribution pattern of the low beam may have a light and darkness boundary line formed by projecting a shape of an edge of an end of the first optical shield 130. The light and darkness boundary line may be configured as a horizontal cutoff line, and in the basic light distribution pattern, a high luminosity region (hot zone) may be formed in the vicinity of a lower side of the cutoff line of the light and darkness boundary line.

In several other exemplary embodiments, the first optical shield 130 may be omitted. For example, in the case of a point light source such as an LED, which may control the cutoff line on the light distribution pattern of the light source, particularly, the first optical shield 130 may be omitted.

The second optical shield 140 may be disposed at the front side of the first light source 110, and may block a portion of the light so as to form the first shaded line 200 on the front light distribution pattern of the vehicle. The first optical shield 130 and the second optical shield 140 may be configured by being separated from each other, but the present invention is not limited thereto, and the first optical shield 130 and the second optical shield 140 may be integrally configured with each other, but may be configured to be independently controlled.

A portion of the second optical shield 140 may be positioned on a focal length of the first lens 150, and the second optical shield 140 may be positioned above the first optical shield 130, but the present invention is not limited thereto. The second optical shield 140 may be configured to be overlapped with the first optical shield 130, or the second optical shield 140 may be spaced apart from the first optical shield 130 at a predetermined interval.

As described above, the first optical shield 130 may block a portion of the light, which enters an upper (upper hemisphere) region of the first lens 150, among the light emitted from the first light source 110, and the second optical shield 140 may be configured to block a portion of the light, which enters a lower (lower hemisphere) region of the first lens 150, among the light emitted from the first light source 110.

As illustrated in FIG. 9, the second optical shield 140 may include a rotation center shaft 141, and a light blocking body 142 having a shape extended from the rotation center shaft 141, and the light blocking body 142 may be extended from the rotation center shaft 141 in a vertical direction. This shape of the second optical shield 140 is just an example, and a configuration, which may block light so as to form a predetermined shaded line, may be adopted without limitation.

As will be described below, as the rotation center shaft 141 may be rotated by a drive means, such as an electric motor, the light blocking body 142 may be set to be positioned at one of a first position for forming the first shaded line 200 and a second position at which the light may be not blocked, that is, which the light does not enter.

FIG. 9 illustrates a state in which the light blocking body 142 may be positioned at the first position for forming the first shaded line 200.

However, referring to FIGS. 11 and 12, another displacement structure of the second optical shield 140 is illustrated. That is, FIGS. 11 and 12 illustrate a configuration in which the light blocking body 142 may be rotated at a predetermined angle so as to be displaced to the second position where light may be not blocked.

In the illustrated example, a configuration is illustrated in which the light blocking body 142 may be rotated in a direction toward the first lens 150, but the present invention is not limited thereto, and the light blocking body 142 may be rotated in the opposite direction toward the first light source 110.

The first lens 150 may configure an outermost surface of the head lamp, and may serve to protect internal constituent elements from external impact. The first lens 150 may be made of a transparent material so that the light generated from the first light source 110 of the head lamp may passes through the first lens 150 toward the front side. As such, in some exemplary embodiments, the first lens 150 may be an aspherical lens.

Figure 13:
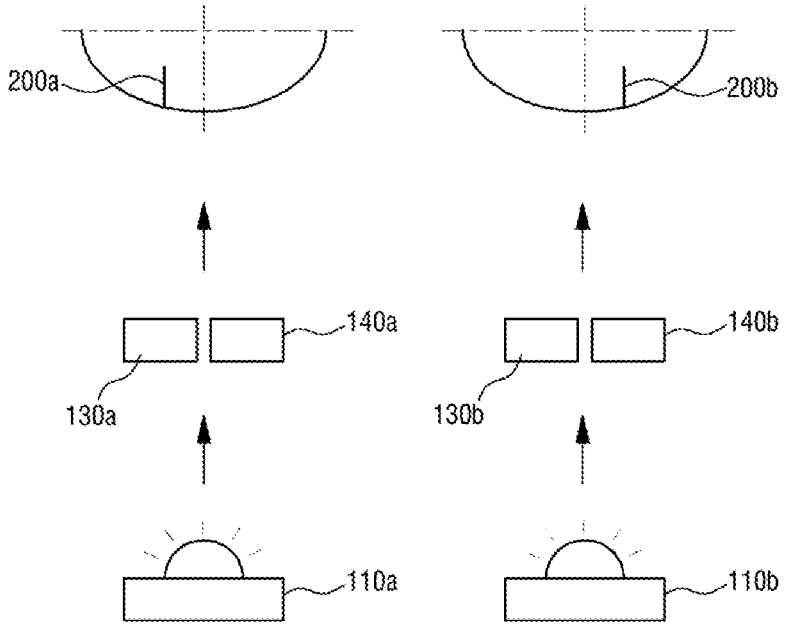
FIG. 13 is a view illustrating a configuration of a head lamp for a vehicle according to another exemplary embodiment of the present invention.
Figure 14:
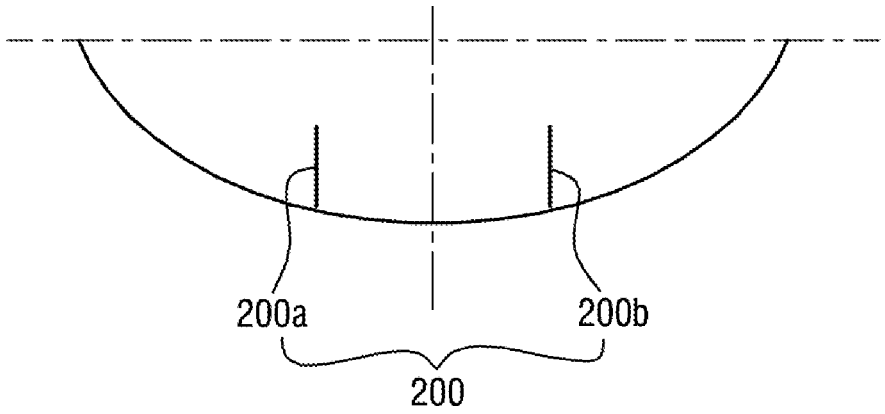
FIG. 14 is a view illustrating a light distribution pattern formed by the head lamp to for a vehicle of FIG. 13.
Figure 15:
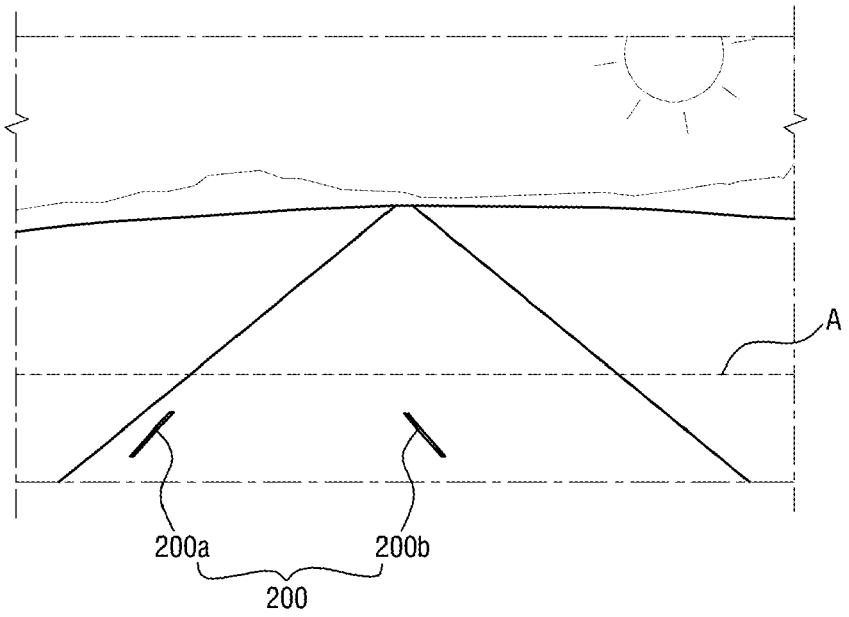
FIGS. 15 and 16 are views illustrating a configuration in which the light distribution pattern of FIG. 14 is irradiated toward a front side of a road.
Figure 16:
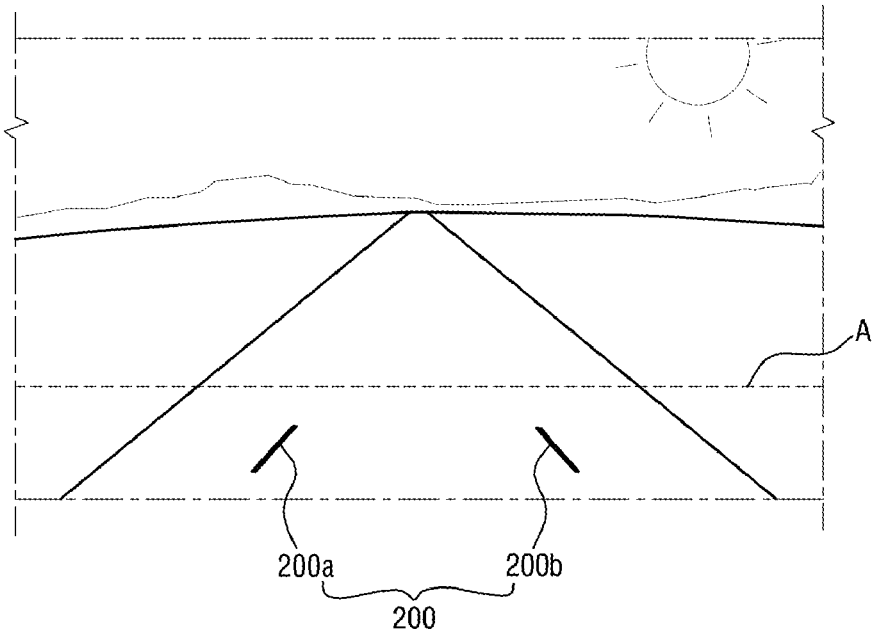

Hereinafter, a head lamp for a vehicle according to another embodiment of the present invention will be described with reference to FIGS. 13 to 16. FIG. 13 is a view illustrating a configuration in which the head lamp for a vehicle according to the embodiment of the present invention may be provided as a pair of head lamps for a vehicle, FIG. 14 is a view illustrating a light distribution pattern formed by the head lamp for a vehicle of FIG. 13, and FIGS. 15 and 16 are views illustrating a configuration in which the light distribution pattern of FIG. 14 may be irradiated toward a front side of a road.

The head lamp for a vehicle according to the exemplary embodiment includes a first light source, a first reflector configured to reflect light generated from the first light source, a first optical shield disposed at a front side of the first light source and configured to block a portion of the light, a second optical shield disposed at the front side of the first light source and configured to block another portion of the light so as to form a first shaded line on a front light distribution pattern of the vehicle, and a first lens configured to emit the incident light toward the front side, and furthermore, may further include a second light source, a second reflector configured to reflect light generated from the second light source, a third optical shield disposed at a front side of the second light source and configured to block a portion of the light, a fourth optical shield disposed at the front side of the second light source and configured to block another portion of the light so as to form a second shaded line on the front light distribution pattern of the vehicle, and a second lens configured to emit the incident light toward the front side.

That is, a pair of head lamps for a vehicle, which has the same structure as each other, may be provided, two light sources may be included in one side head lamp, or one light source may be included in each of the head lamps positioned at both left and right sides.

For convenience, the first light source and the second light source are denoted by the same reference number, but separated by 'a' and b', and the same applies to the other constituent elements.

The head lamp for a vehicle according to the exemplary embodiment may include a first head lamp configured to block a portion of a first light emitted from the first light source 110*a* so as to form a first shaded line 200*a* on a front road of the vehicle, and a second head lamp configured to block a portion of a second light emitted from the second light source 110*b* so as to form a second shaded line 200*b* on the front road of the vehicle.

For example, the first head lamp and the second head lamp may configure left and right head lamps of the vehicle, respectively, and the order of the left and right head lamps may be changed.

Referring to FIG. 13, a predetermined light may be emitted from the left light source 110*a* of the head lamp, and a predetermined light distribution pattern may be formed through the first optical shield 130*a*, and at the same time or sequentially, when the light passes over the second optical shield 140*a*, the light distribution pattern may be formed at the front side, and the first shaded line 200*a* may be formed.

The first shaded line 200*a* may be a region having a brightness value, which may be less than a brightness value at the periphery thereof or close to zero, on the light distribution pattern, and may have a predetermined brightness value or less, for example, brightness of 100 cd or less. The first shaded line 200*a* may be formed such that when the head lamp irradiates light at night, the first shaded line 200*a* having a slit or bar shape may be formed to be extended in a predetermined direction.

In addition to the slit or bar shape, the first shaded line 200*a* may have other shapes, which may indicate the vehicle width of the vehicle, without limitation. For example, the first shaded line 200*a* may be displayed in a shape that partially includes a curved line in addition to a straight line.

In addition, the first shaded line 200*a* is illustrated in the form of a continuous line that is not cut, but the present invention is not limited thereto, and may be configured in the form of a dotted line, a dash-dot line, or the like within a distinguishable range of the vehicle driver Similarly, a predetermined light may be emitted from the right light source 110*b* of the head lamp, and a predetermined light distribution pattern may be formed through the third optical shield 130*b*, and at the same time or sequentially, when the light passes over the fourth optical shield 140*b*, the light distribution pattern may be formed at the front side, and the second shaded line 200*b* may be formed.

The second shaded line 200*b* may be also a region having a brightness value, which may be less than a brightness value at the periphery thereof or close to zero, on the light distribution pattern, and may have a predetermined brightness value or less, for example, brightness of 100 cd or less. The second shaded line 200*b* may be formed such that when the head lamp irradiates light at night, the second shaded line 200*b* having a slit or bar shape may be formed to be extended in a predetermined direction.

In several other exemplary embodiments, the first shaded line 200*a* and the second shaded line 200*b* may have different brightness or the same brightness.

Similarly, the second shaded line 200*b* may also have other shapes that may display the vehicle width of the vehicle, in addition to the slit or bar shape, without limitation. For example, the second shaded line 200*b* may be displayed in a shape that partially includes a curved line in addition to a straight line.

Referring to FIG. 14, as described above, the light distribution irradiated from the respective left and right head lamps are may be mixed so as to form a single light distribution pattern. On the mixed light distribution pattern, the first shaded line 200*a* formed by one side first head lamp and the second shaded line 200*b* formed by the other side second head lamp may form the pair of shaded lines 200, and as described above, a distance between the first shaded line 200*a* and the second shaded line 200*b* may be the same as the vehicle width of the vehicle, or may be substantively the same as the vehicle width of the vehicle within an allowable predetermined error range. In the exemplary embodiment, the distance between the first shaded line 200*a* and the second shaded line 200*b* may mean the distance between the first shaded line 200*a* and the second shaded line 200*b* on the light distribution pattern projected on the road, and may have a difference with the vehicle width within a predetermined range. For example, an error within a range in which it may be difficult for the vehicle driver to detect the error may be allowable.

Here, the vehicle width may mean a width between a left outermost point of the vehicle, for example, an outermost point of a left side mirror and a right outermost point of the vehicle, for example, an outermost point of a right side mirror. The distance between the first shaded line 200*a* and the second shaded line 200*b* on the light distribution pattern projected on the road may be a concept including thicknesses of the first shaded line 200*a* and the second shaded line 200*b*, and may be a concept that means a distance between outermost lines of sides adjacent to the shaded lines except for the thicknesses of the shaded lines.

As such, the pair of shaded lines 200 may be formed on the head lamp pattern, for example, the low beam pattern projected on the road, and the pair of shaded lines 200 indicates the vehicle width of the vehicle, thereby providing guide lines in a case in which the vehicle driver needs to pass through a narrow space.

Referring to FIGS. 15 and 16, a configuration and a function of the pair of shaded lines 200, which are implemented by the head lamp for a vehicle according to the present embodiment, are illustrated.

According to the head lamp for a vehicle according to the present embodiment, the pair of shaded lines 200 may be formed on the head lamp light distribution pattern projected on the front road of the driving vehicle. As illustrated, the first shaded line 200*a* and the second shaded line 200*b* may be formed in a range in which the first shaded line 200*a* and the second shaded line 200*b* do not cross a reference line A illustrated within a predetermined distance from the vehicle. That is, the first shaded line 200*a* and the second shaded line 200*b* may be formed between the vehicle and the reference line A.

Particularly, the pair of shaded lines 200 may be formed within a range that satisfies regulations on the light distribution in relation to the low beam in a short distance region, and the distance between the vehicle and the reference line A of the pair of shaded lines 200 may be 25 m in consideration with the regulations. When the pair of shaded lines 200 are formed in a region where the distance between the vehicle and the reference line A exceeds 25 m, because a point at which the pair of shaded lines 200 is formed is adjacent to the front side of the vehicle, that is, close to zero degree as a vertical axis on the light distribution graph, the regulations on the light distribution may not be satisfied in accordance with the thicknesses of the pair of shaded lines 200. When the pair of shaded lines 200 are formed in a region where the distance between the vehicle and the reference line A exceeds 25 m, the pair of shaded lines 200 may not be formed on the front road, or only a part of the pair of shaded lines 200 may be formed on the road.

Therefore, the pair of shaded lines 200 may be formed within a predetermined distance on the basis of a foremost side of the vehicle, for example, in the range of 25 m.

In addition, as illustrated, the first shaded line 200*a* and the second shaded line 200*b* may be parallel to each other, and the first shaded line 200*a* and/or the second shaded line 200*b* may be parallel to the proceeding direction of the vehicle.

FIG. 15 illustrates a state in which the shaded lines 200, which may be formed on the light distribution pattern projected on the road, are formed at a center of the road, and may mean that the vehicle, which may be driven in a predetermined traffic lane, is being driven while maintaining the position of the vehicle at a central position of the traffic lane. In this case, the above state means that the vehicle is being normally driven, and a risk of an accident is low in comparison to when the vehicle is driven while being biased to one side of the traffic lane.

However, FIG. 16 illustrates a state in which the shaded lines 200, which is formed on the light distribution pattern projected on the road, are formed to be biased to one side of the road, and may indicate that the vehicle, which is driven in a predetermined traffic lane, is being driven while being biased to one side of the traffic lane. In this case, a risk of contact and collision with a vehicle which is being driving in another traffic lane may increase, and the above situation may be recognized by the driver of the rear vehicle as a risk factor. Therefore, after the driver of the vehicle confirms the shaded lines 200 formed at the front side of the host vehicle, and then compares the shaded lines 200 with the shape of the road traffic lane, the driver intuitively and immediately may recognize a state in which the vehicle is biased to one side of the traffic lane or a case in which the vehicle is driven in a state of crossing the traffic lane, and may move the host vehicle to the central position of the traffic lane by operating a steering or the like.

In several other exemplary embodiments, the head lamp for a vehicle may further include a camera module configured to obtain an image of the road in front of the vehicle, the shaded lines 200 and a shape of the road or a shape of the traffic lane are extracted and compared, and when the shaded lines 200 are biased from the center of the road or the traffic lane at a predetermined range or more is continued for a predetermined time or more, the information is transmitted to the driver such that a vehicle accident due to driving while drowsy or a careless driving may be also prevented.

Figure 17:
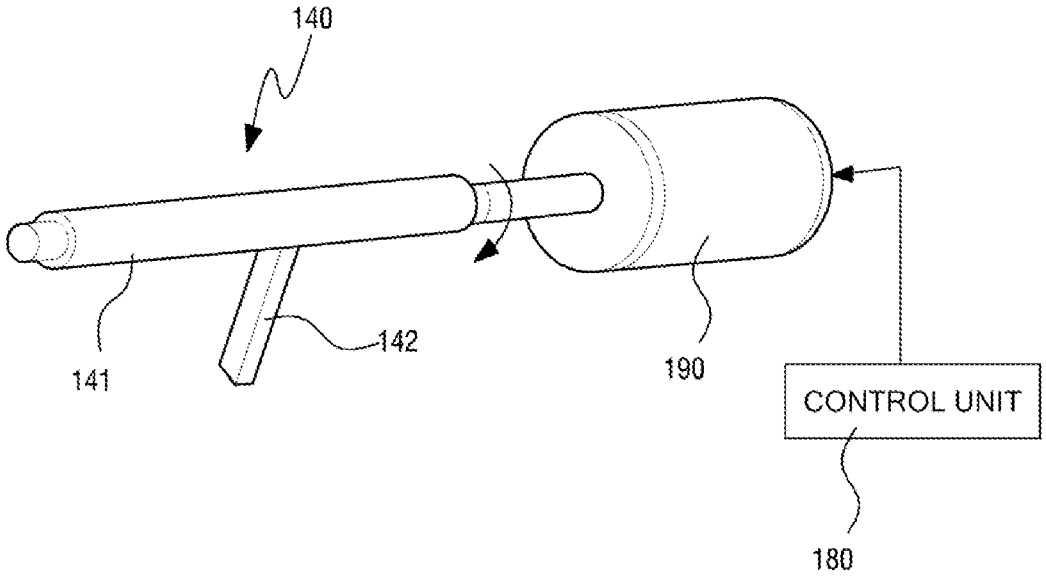
FIG. 17 is a view illustrating a schematic structure of a head lamp for a vehicle according to yet another exemplary embodiment of the present invention.

Hereinafter, a head lamp for a vehicle according to yet another exemplary embodiment of the present invention will be described with reference to FIGS. 17 and 18. FIG. 17 is a view illustrating a schematic structure of a head lamp for a vehicle according to yet another embodiment of the present invention, and FIG. 18 is a view illustrating a control principle of the head lamp for a vehicle of FIG. 17.

The head lamp for a vehicle according to the exemplary embodiment includes the same configurations as those of the previous embodiments, but may further include a control switch 170, and a controller 180. The control switch 170 may be provided in a steering apparatus or at a front side of a vehicle driver seat so that the vehicle driver may operate the control switch 170, but the present invention is not limited thereto.

The control switch 170 may generate a predetermined signal in accordance with an operation of the vehicle driver, and thereby positions of the aforementioned second optical shields 140*a* and 140*b* are displaced such that positions of the light blocking bodies 142*a* and 142*b* may be set to be the first position or the second position.

Figure 18:
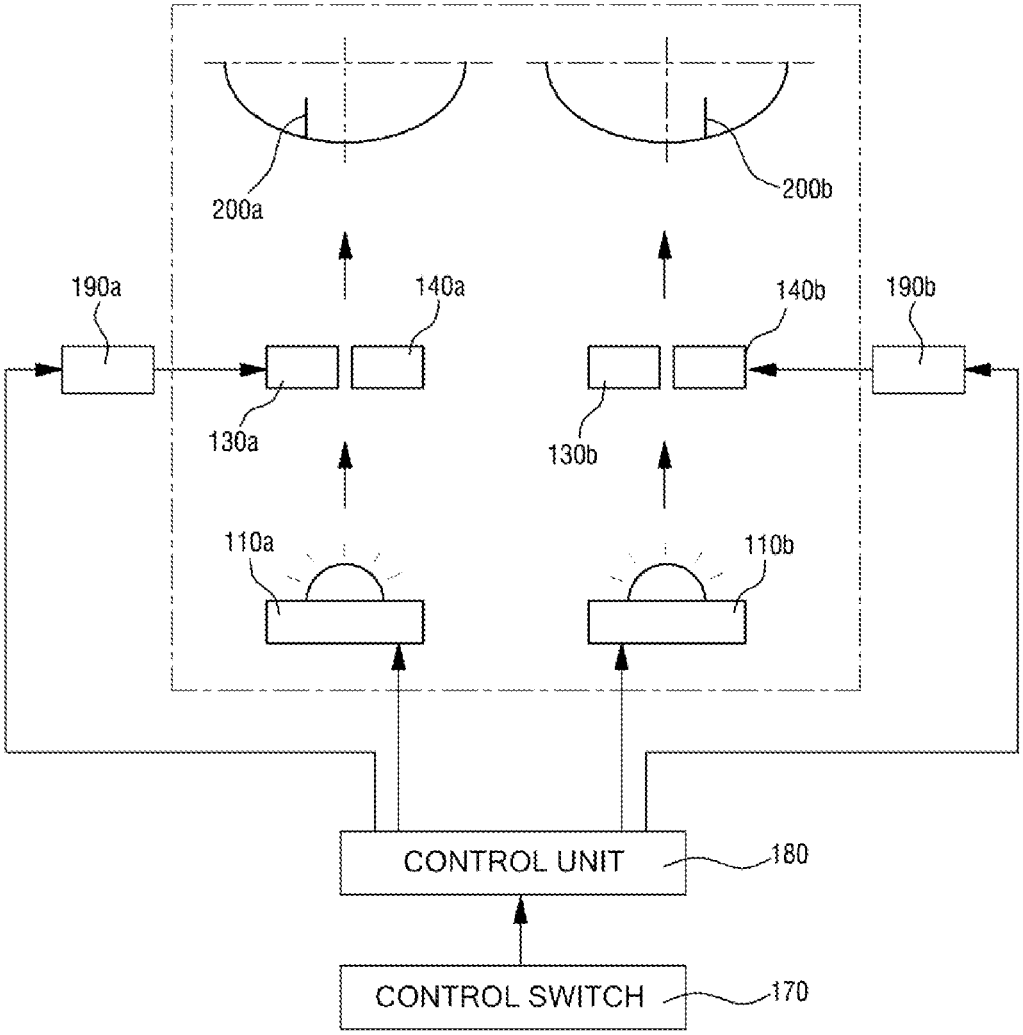
FIG. 18 is a view illustrating a control principle of the head lamp for a vehicle of FIG. 17.

To this end, as illustrated in FIG. 18, the head lamp for a vehicle according to the exemplary embodiment may further include drive apparatuses 190*a* and 190*b* which is connected to the rotation center axes 141*a* and 141*b* and rotates the second optical shields 140*a* and 140*b*.

A signal generated by the control switch 170 may be transmitted to the controller 180, the transmitted signal is transmitted to the drive apparatuses 190*a* and 190*b*, for example, an actuator or the like such that torque or the like may be generated, and the generated force may be transmitted to the second optical shields 140*a* and 140*b*.

The controller 180 may control the first head lamp and the second head lamp, and the first shaded line and/or the second shaded line may be formed or released by control signals of the controller 180.

That is, as illustrated in FIG. 17, signals for controlling the light sources 110*a* and 110*b* of the left and right head lamps and the drive apparatuses 190*a* and 190*b* are transmitted through the controller 180, and an operation of switching on and off the light sources 110*a* and 110*b* of the left and right head lamps, illumination thereof, or the like may be controlled by the respective signals. In addition, a signal, which controls operations of the drive apparatuses 190*a* and 190*b*, is transmitted such that the drive apparatuses 190*a* and 190*b* are operated by the signal so as to form the shaded lines, or the operations of the drive apparatuses 190*a* and 190*b* may be controlled so that the shaded lines are not formed.

As described above, according to the head lamp for a vehicle of the exemplary embodiments of the present invention, the pair of shaded lines, which correspond to the vehicle width, is formed on the light distribution pattern irradiated to the front side of the vehicle such that the vehicle driver may safely drive or park the host vehicle in a narrow space based on the pair of shaded lines.

In addition, the pair of shaded lines by which the driver may intuitively identify the vehicle width of the host vehicle is formed, thereby preventing an unintentional minor collision with other vehicles, bicycles, or motorcycles, or an injury accident.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A head lamp for a vehicle, comprising:

a first light source to generate light;

a first reflector configured to reflect light generated from the first light source;

a first optical shield disposed at a front side of the first light source and configured to block a portion of the light so as to form a first shaded line on a front light distribution pattern of the vehicle;

a first lens configured to emit incident light toward the front side;

a second light source to generate light;

a second reflector configured to reflect the light generated from the second light source;

a third optical shield disposed at the front side of the second light source and configured to block a portion of the light so as to form a second shaded line on the front light distribution pattern of the vehicle; and a second lens configured to emit the incident light toward the front side, wherein a distance between the first shaded line and the second shaded line indicates the vehicle width.

2. The head lamp of claim 1, wherein a portion of the first optical shield is positioned on a focal length of the first lens.

3. The head lamp of claim 1, further comprising:

a second optical shield disposed at the front side of the first light source and configured to block another portion of the light, wherein the first optical shield is positioned above the second optical shield.

4. The head lamp of claim 1, wherein the first optical shield blocks a portion of the light, which is entering a lower hemisphere region of the first lens.

5. The head lamp of claim 1, further comprising:

a second optical shield disposed at the front side of the first light source and configured to block another portion of the light, wherein the first optical shield is spaced apart from the first optical shield at a predetermined interval.

6. The head lamp of claim 1, wherein the first optical shield includes a rotation center shaft, and a light blocking body having a shape extended from the rotation center shaft.

7. The head lamp of claim 6, wherein the light blocking body is extended from the rotation center shaft in a vertical direction.

8. The head lamp of claim 6, wherein the light blocking body is set to be positioned at one of a first position for forming the first shaded line and a second position where the light does not enter.

9. The head lamp of claim 8, further comprising:

a control switch configured to turn on and off the light blocking body, wherein a position of the light blocking body is determined as one of the first position and the second position by an operation of the control switch.

10. The head lamp of claim 6, further comprising:

a drive apparatus connected to the rotation center shaft and configured to rotate the first optical shield.

11. The head lamp of claim 10, further comprising:

a controller configured to transmit a control signal to the first light source, wherein the controller transmits a drive signal that controls the drive apparatus.

12. The head lamp of claim 1, wherein the first shaded line is parallel to a proceeding direction of the vehicle.

13. The head lamp of claim 1, wherein the first shaded line is formed within a predetermined distance from the vehicle.

14. The head lamp of claim 13, wherein the predetermined distance is 25 m.

15. The head lamp of claim 1, wherein the first shaded line and the second shaded line are parallel to each other.

16. The head lamp of claim 1, further comprising:

a fourth optical shield disposed at the front side of the second light source and configured to block another portion of the light.

17. A head lamp for a vehicle, comprising:

a first light source to generate light;

a first optical shield disposed at a front side of the first light source and configured to block a portion of the light so as to form a first shaded line on a front light distribution pattern of the vehicle;

a first lens configured to emit incident light toward the front side of the head lamp;

a second light source to generate light;

a third optical shield disposed at the front side of the second light source and configured to block a portion of the light so as to form a second shaded line on the front light distribution pattern of the vehicle; and a second lens configured to emit the incident light toward the front side, wherein a distance between the first shaded line and the second shaded indicates the vehicle width.

* * * * *